United States Patent [19]

Cantley

[11] 4,341,166

[45] Jul. 27, 1982

[54] SAFE STORAGE BOX

[76] Inventor: Ross H. Cantley, 577 Essex Rd., Beaconsfield, Quebec, Canada

[21] Appl. No.: 181,213

[22] Filed: Aug. 25, 1980

[51] Int. Cl.[3] ..... E05G 1/08; A47B 88/04

[52] U.S. Cl. ..... 109/53; 109/64; 312/222; 312/333; 70/367; 70/85

[58] Field of Search ..... 109/56, 57, 55, 54, 109/53, 64, 45; 312/333, 222; 70/367, 85

[56] References Cited

U.S. PATENT DOCUMENTS

| | | | |
|---|---|---|---|
| 2,257,741 | 10/1941 | Gray | 70/85 |
| 3,276,835 | 10/1966 | Hall | 312/333 |
| 3,970,010 | 7/1976 | Cantley | 70/85 |
| 4,073,554 | 2/1978 | Oder | 109/53 |
| 4,262,607 | 4/1981 | Krebs | 109/45 |

*Primary Examiner*—Reinaldo P. Machado

*Attorney, Agent, or Firm*—Diller, Ramik & Wight

[57] ABSTRACT

A safe deposit box system which is either front loading or side loading. Each of the safe storage boxes has an integral lock housing adapted to be locked into the frame forming the compartments into which the safe storage boxes are retained. The lock housing has a latch operated by a lock device in the housing, and there is provided a latch receiving seat in the frame defining the compartment, and the material of the lock housing is of a sturdier construction than the material forming the construction of the tray of the safe storage box.

4 Claims, 7 Drawing Figures

Fig. 1
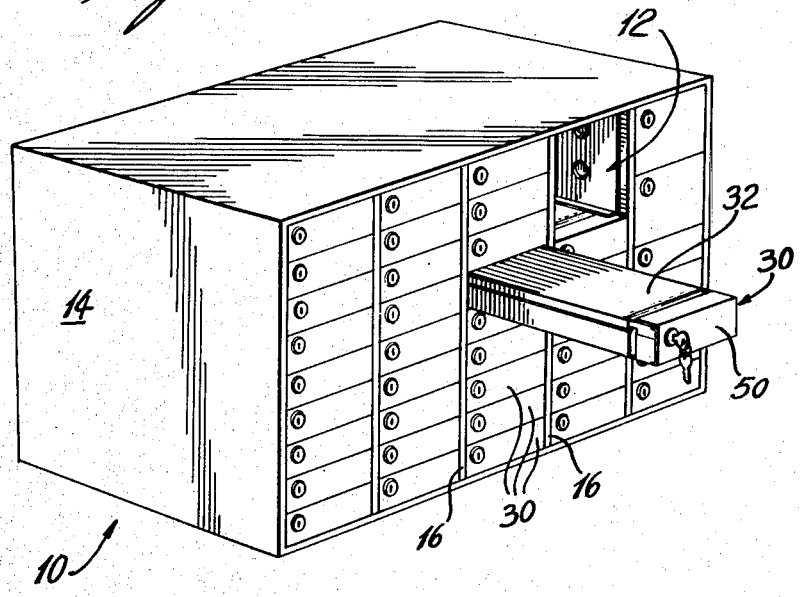
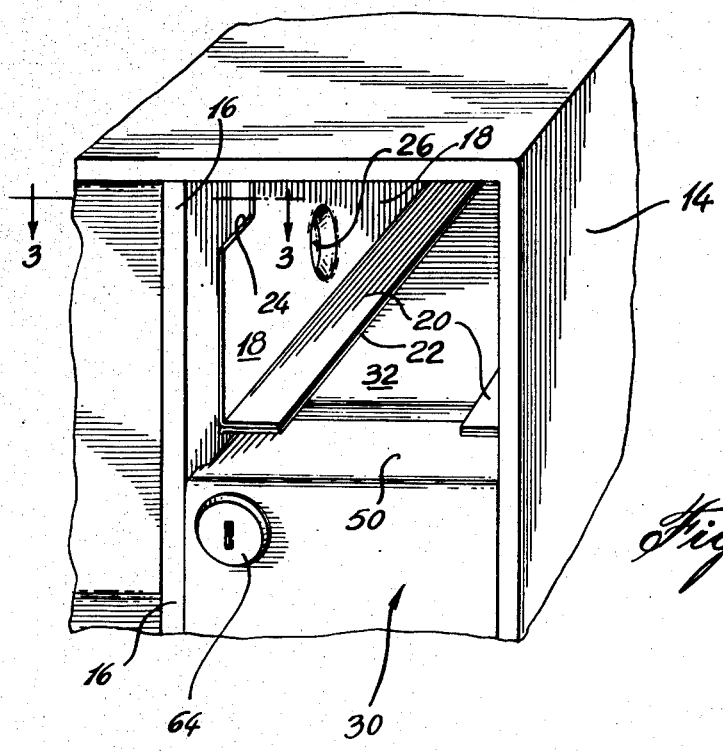
Fig. 2

SAFE STORAGE BOX

BACKGROUND OF THE INVENTION

1. Field of the Invention

The present invention relates to safe storage boxes, and more particularly, to improvements in the construction of safe storage boxes.

2. Description of the Prior Art

In my U.S. Pat. No. 3,970,010, issued July 20, 1976, a safe storage box system is described which comprises a closeable, safe-type housing including a sliding frame movable from within the housing and defining side-loading safe storage box receiving compartments. As described in that patent, each safe storage box has a hinged cover and an integral front door portion to which is fixed a latch type lock. The safe storage box system illustrated in that patent has proved very successful and has met a previously unsatisfied need.

Improvements have been made relating to the lock housing and the arrangement of the locking device with the frame.

For instance, it has been discovered that although it was not necessary to have a separate lockable door when utilizing the system in accordance with U.S. Pat. No. 3,970,010, in accordance with that system, there was provided a safe chest with a hinged safe door which prevented access to the safe storage boxes, and thus the overall system was safer than conventional safe deposit boxes. The metal conventionally used for safe storage boxes is a relatively soft metal, and the front wall of the lock housing, in the above patent, being part of the lid, was thus made of relatively soft metal.

U.S. Pat. No. 3,276,835, Hall, issued Oct. 4, 1966, describes a money box for use in coin machines including a box and a front end attachment which is readily removable from the box. The attachment houses the locking devices and is adapted to fit and lock onto a wall of the apparatus. The front end unit may be easily separated from the box for interchangeability. The Hall patent includes a number of hook-like projections extending from the box proper to engage, in an easily separable manner, the front end attachment so that the money boxes may be easily removed and shipped to a centralized collection station.

There exists on the market a safe deposit box sold by The Gross-Feibel Company, of Hillsboro, Ohio, and sold under the trade name "Lockbox" and identified as the "Lockbox modular unit system". This "Lockbox" modular unit system is apparently manufactured by Miles Osborn, Inc., of 1511 E. Edinger Avenue, Santa Ana, California 92705, U.S.A. The "Lockbox", in accordance with published brochures and the box available on the market, includes a plastic tray portion with a hingeable plastic cover and a lock unit fastened to the front face thereof, the lock unit including a cast or forged metal housing with locking latches adapted to engage recesses provided in a frame on which the lock box is to be set. The front of the forged lock unit includes a front plate which somewhat conforms with the dimensions of the opening into which the tray is submitted.

SUMMARY OF THE INVENTION

It is an aim of the present invention to provide an improved safe deposit box having a lock housing front wall which is structurally sturdier than the remainder of the safe storage box.

It is an aim of the present invention to provide a safe storage box in a safe storage system which is simpler than the money box shown in the Hall patent or the Gross-Feibel "Lockbox" and which is more economical to produce, yet has features which are better suited to the use of safe storage boxes that are not found in the Hall patent or the "Lockbox" or conventional safe storage boxes.

It is an aim of the present invention to have a safe deposit box which has a tray and a hinged lid covering the top opening of the tray and a separate lock unit fixedly attached to the front wall of the tray adapted to block off the opening of the compartment of a frame and including locking means provided therein for locking the unit within the compartment of the frame, wherein the material used to construct the lock unit is much stronger than the material used to fabricate the tray portion. The structure of the tray, however, is such that it is stronger than conventional trays.

It is a further aim of the present invention to provide a unique and simple attachment arrangement for fixing the lock unit to the front wall of the tray.

A construction in accordance with the present invention comprises a safe storage box having an elongated tray of sheet metal defining an open top, a planar front wall, side walls which extend beyond the front wall, a lid hinged to the tray and covering the open top, a frame defining a plurality of tray receiving compartments, each compartment having an open end defined by marginal members, the safe storage box including a lock housing attached to the front wall, the housing having dimensions and a peripheral shape defined by the opening and at least partially by the marginal members such that the lock housing will just slide through the opening, a latch receiving seat defined by at least one of the marginal members, a lock operated latch provided in the housing and adapted to protrude into the latch receiving seat when the box is locked in the frame, and the lock housing being made of a sturdy sheet metal formed in at least a channel-shaped elongated member with its longitudinal axis perpendicular to the longitudinal axis of the tray, the side wall extensions closing the open ends of the elongated member, one of the legs of the channel forming the front face of the lock housing and the other leg forming an attachment panel.

The construction of the present invention as described offers advantages of versatility and economy in the fabrication of safe storage boxes. For instance, the channel-shaped member can be extruded or bent and cut to any given length or width depending on the desired size of the proposed safe deposit box opening. The height of the front wall of the channel or safe deposit box can be adjusted by changing the extrusion die or by bending the channel of sheet material with a higher front leg.

In a more specific embodiment of the present invention, the front leg of the channel-shaped lock housing is provided with an inwardly extending web and an upwardly extending flange, and the flange is adapted to engage a frontward extension of the bottom wall of the tray and associated openings therein, while the rear leg of the channel is adapted to be fastened to the front panel of the tray. Thus, the housing is complete with the bottom and ends of the housing being provided by extensions of the tray and the sturdier sheet metal forming the front wall and top wall of the lock housing. The housing can be reasonably easily removed by removing the fastening means attaching the rear leg of the channel to the front panel of the tray and disengaging the flange from the opening in the bottom wall of the tray.

BRIEF DESCRIPTION OF THE DRAWINGS

The invention will now be described with reference to the accompanying drawings which show a preferred form thereof and wherein:

FIG. 1 is a perspective view of a safe storage unit;

FIG. 2 is an elongated fragmentary perspective view of a detail of FIG. 1;

DESCRIPTION OF THE PREFERRED EMBODIMENTS

Figure 3:
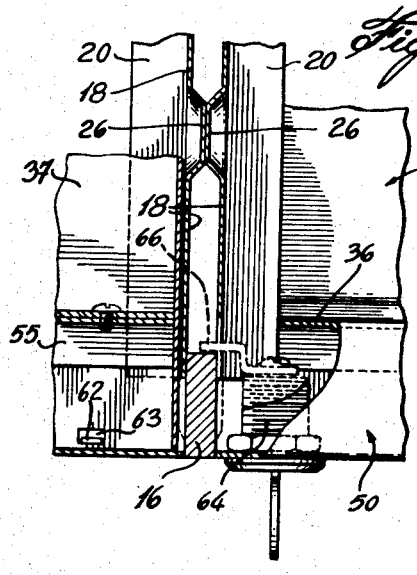
FIG. 3 is a fragmentary top horizontal section taken along line 3—3 of FIG. 2.
Figure 7:
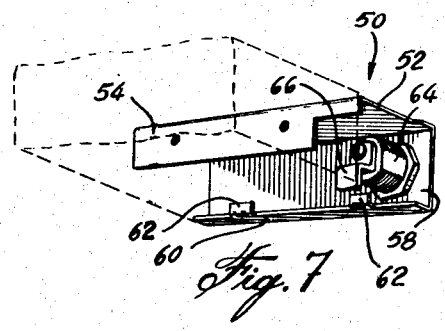
FIG. 7 is a perspective view of a detail of FIG. 4.

The safe storage unit 10, shown in FIG. 1, may be used in a safe whereby the unit 10 would be mounted on sliding tracks and adapted for side loading, as described in my U.S. Pat. No. 3,970,010. The safe storage unit illustrated in FIG. 1 includes a frame 12 having a frame housing 14. A number of safe storage boxes 30 are loaded in the frame housing 14, as illustrated.

The frame 12 includes vertical rigid steel bars 16 spaced apart the width of the compartment which are to be formed for receiving the safe storage boxes 30. Arranged vertically on the bars 16 and on similar support bars provided in the frame are side plates 18. Each side plate 8 has a lower flange 20 and an upper flange 22. The flanges are co-extensive and adjacent each other such as to provide inwardly extending tracks for allowing the safe storage boxes 30 to slide in the compartment.

Each side member 18 is provided with a latch receiving opening 24 adapted to receive a locking latch, as will be described later.

The side plates 18 are provided with dimples 26, as can be seen best in FIG. 3, which provide stability when corresponding dimples are abutting one another, as shown in FIG. 3.

Figure 4:
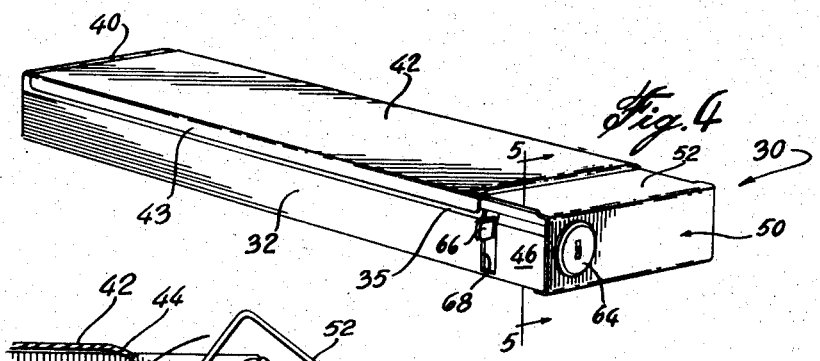
FIG. 4 is a perspective view of a typical element of FIG. 1.
Figure 6:
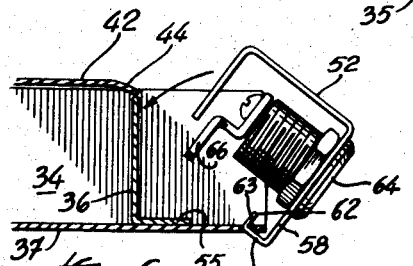
FIG. 6 is a fragmentary vertical cross-section similar to FIG. 5 but showing a detail thereof in a different operative position.
Figure 5:
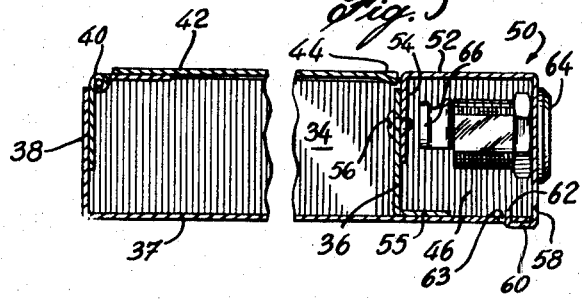
FIG. 5 is a vertical cross-section taken along line 5—5 of FIG. 4.

Referring now to FIG. 4, there is shown a typical safe storage box 30 having a tray portion 32 and a lock housing 50. The tray portion 32 has side walls 34, and each side wall is stepped inwardly slightly, as shown in FIG. 4, at 35. The tray also includes a front wall 36, a rear wall 38, a hinge 40, and a lid 42. The lid 42 covers the open top portion of the tray 32 and is hinged by the hinge device 40. Finally, the lid 42 has a downwardly extending lip 44 at the front end thereof coinciding with the front wall 36. The lid 42 also has downwardly depending lips 43 which match with the indentations 35 and which are designed to snap into place, thus holding the lid 42 closed. The tray 32 also has a bottom wall 37. The tray 32 has side wall extensions 46, in this particular embodiment, which extend beyond the front wall 36. A bottom wall extension 48 is also provided.

The locking housing 50 is formed somewhat as a U-shaped channel having a top wall 52 with a downwardly extending rear leg 54 and a front leg forming the front wall 58. The front wall 58 has a lower horizontal flange 60 with an upward projection 62.

An aperture can be provided on the front wall 58 for insertion of the lock 64. This portion of the housing represented by the numeral 50 can be made of sheet material such as a strong stainless steel by bending or aluminum alloy by extruding. The length of the housing 50, that is, the width of the actual box front wall is cut from a length of the bent or extruded channel according to the specifications required. The height of the front wall can also be set to specifications by necessary bending or by modifying the die through which it may be extruded.

The ends of the housing are, of course, blocked off by the extensions 46 of the tray while the bottom wall extension 48 forms the bottom wall of the housing. Recesses 63 are provided in the bottom wall extension 48 for receiving the projections 62. Fasteners 56 are provided for fastening the leg 54 to the wall 36 of the tray.

In operation, when the lock housing 50 is mounted to the front of the tray 32, the upward projections 62 engage recesses 63 in the bottom wall extension 48, and the housing 50 is pivoted until the leg 54 abuts against the front wall 36 and machine screws 56 fix the leg 54 and the front wall 36 together. The front wall 36 may have a lower horizontal flange 55 to reinforce it thereon. A latch-type lock 64 is provided having a latch 66. The latch 66 is adapted to swivel through an opening 68 in the side wall extension 46 to engage in the latch receiving opening 24 and thereby lock itself against the rear surface of the bar 16.

The tray 32 proper and the lid 42 can be made of metal material, such as aluminum or steel, and also plastic. However, the front lock housing 50 may be of sheet metal material, such as stainless steel. The front wall 58 of the housing 50 is adapted to fill the compartment opening defined by the marginal bars 16 and the tracks formed by the flanges 20 and 22. Accordingly, when the safe storage box is fitted into a typical compartment, and the latch 66 is in a locking position against the bar 16, as shown in FIG. 3, it is very difficult to obtain access to the safe storage box tray 32. Of course, when the safe storage box is in the compartment, the lid 42 cannot be lifted since it is held closed by the flanges 22 defining the uppermost portion of the compartment.

I claim:

1. A safe storage box in combination with a frame for receiving the box, the box comprising an elongated tray defining an open top, a front wall, a lid hinged to the tray and covering the open top, the frame defining a plurality of tray receiving compartments, each compartment having an opening defined by marginal members, the safe storage box including a lock housing attached to the front wall, the housing having dimensions and a peripheral shape defined by the opening and at least partially by the marginal members such that the lock housing will just slide through the opening, a latch receiving seat defined by at least one of the marginal members, a lock operated latch provided in the housing and adapted to protrude into the latch receiving seat when the box is locked in the frame, and the lock housing being made of a sturdy metal formed in at least a channel-shaped elongated member having open ends and a pair of parallel legs with its longitudinal axis perpendicular to the longitudinal axis of the tray, extensions of the tray closing the open ends of the elongated member, one of the legs of the channel forming the front wall of the lock housing and the other leg forming the attachment panel to the front wall of the tray, and the extensions of the tray forming the ends of the lock housing enclosing the lock housing.

2. A safe storage box as defined in claim 1, wherein the marginal members include at least a pair of parallel rigid bars fixed in the frame and defining a portion of the front opening of the compartment.

3. A safe storage box as defined in claim 2, wherein the parallel marginal members extend vertically in the frame and the latch receiving seat is provided behind each vertically extending bar in each compartment.

4. A safe storage box as defined in claim 1, wherein the safe storage box includes a bottom wall, upstanding side walls and a rear wall, the bottom and side walls extending beyond the front wall, the lock housing adapted to be detachably engaged to the front wall, the front wall of the lock housing being rectangular, the attachment panel abutting in parallel relationship with the front wall, the lock housing also having a bottom depending flange extending inwardly from the front wall of the lock housing and including a pair of upwardly extending projections adapted to hingedly engage in slots located in the front extension of the bottom wall of the tray, and means for securing the attachment of the attachment panel depending from the top wall of the housing to the front wall of the tray such that the housing is fixedly attached to the front of the tray, one of the side wall extensions including a slot adapted to allow the latch to protrude therefrom.

* * * * *